US010334714B2

(12) United States Patent
Bernstein

(10) Patent No.: US 10,334,714 B2
(45) Date of Patent: Jun. 25, 2019

(54) ATOM AND ION SOURCES AND SINKS, AND METHODS OF FABRICATING THE SAME

(71) Applicant: THE CHARLES STARK DRAPER LABORATORY, INC., Cambridge, MA (US)

(72) Inventor: Jonathan J. Bernstein, Medfield, MA (US)

(73) Assignee: THE CHARLES STARK DRAPER LABORATORY, INC., Cambridge, MA (US)

( * ) Notice: Subject to any disclaimer, the term of this patent is extended or adjusted under 35 U.S.C. 154(b) by 0 days.

(21) Appl. No.: 15/724,906

(22) Filed: Oct. 4, 2017

(65) Prior Publication Data

US 2018/0098411 A1 Apr. 5, 2018

Related U.S. Application Data

(60) Provisional application No. 62/403,970, filed on Oct. 4, 2016.

(51) Int. Cl.
*H05H 3/02* (2006.01)
*H01J 27/02* (2006.01)
(Continued)

(52) U.S. Cl.
CPC ..... *H05H 3/02* (2013.01); *B22F 7/04* (2013.01); *B28B 11/243* (2013.01); *C25D 3/12* (2013.01);
(Continued)

(58) Field of Classification Search
CPC ..... H05H 3/02; B22F 7/04; B28B 11/243; C25D 3/12; C25D 3/562; C25D 5/022;
(Continued)

(56) References Cited

U.S. PATENT DOCUMENTS 5,270,741 A * 12/1993 Hosaka ..... G03G 15/323 347/125
8,999,123 B2 4/2015 Bernstein et al.
(Continued)

OTHER PUBLICATIONS

J. Bernstein et al., "Solid State Electrochemical Alkali Sources for Cold Atom Sensing", Technical Digest, Solid-State Sensors, Actuators and Microsystems Workshop, Hilton Head Island (Jun. 5-9, 2016).

(Continued)

*Primary Examiner* — Nicole M Ippolito
(74) *Attorney, Agent, or Firm* — Lando & Anastasi, LLP

(57) ABSTRACT

A bi-directional device for generating or absorbing atoms or ions. In some embodiments, the device comprises a solid-phase ion-conducting material, a first electrode positioned on a first surface of the solid-phase ion-conducting material, and a second electrode positioned on a second surface of the solid-phase ion-conducting material. The first electrode includes a plurality of triple phase boundaries, each located at an interface between the solid-phase ion-conducting material and the first electrode. A density of the triple phase boundaries is in the range of about $10^4$ m/m$^2$ to about $2\times10^7$ m/m$^2$ on the first surface of the ion-conducting material. A method of operating the bi-directional device and a method of fabricating a bi-directional device are also provided.

31 Claims, 15 Drawing Sheets

(51) Int. Cl.

| | |
|---|---|
| ***G21K 1/00*** | (2006.01) |
| ***B28B 11/24*** | (2006.01) |
| ***B22F 7/04*** | (2006.01) |
| ***C25D 3/12*** | (2006.01) |
| ***C25D 3/56*** | (2006.01) |
| *C25D 5/02* | (2006.01) |
| *C25D 13/02* | (2006.01) |

(52) U.S. Cl.
CPC ..... *C25D 3/562* (2013.01); *G21K 1/00* (2013.01); *H01J 27/02* (2013.01); *C25D 5/022* (2013.01); *C25D 13/02* (2013.01)

(58) Field of Classification Search
CPC ..... C25D 13/02; G21K 1/00; H01J 27/02; G21Y 2002/30; G21Y 2004/30
USPC ..... 250/423 R, 424, 397, 251; 204/471
See application file for complete search history.

(56) References Cited

U.S. PATENT DOCUMENTS

2007/0054798 A1* 3/2007 Ruud ..... C25B 11/00 502/101
2009/0009922 A1* 1/2009 Hirai ..... H01T 19/04 361/213
2010/0209804 A1* 8/2010 Shin ..... H01M 4/8817 429/483
2011/0247942 A1* 10/2011 Bernstein ..... C22B 26/10 205/560
2016/0096151 A1* 4/2016 Serra ..... C01G 37/006 585/661

OTHER PUBLICATIONS

Kang et al., "A low-power reversible alkali atom source", Applied Physics Letters, 110, 244101, DOI: 101063/1.4986197 (Jun. 13, 2017).

* cited by examiner

ATOM AND ION SOURCES AND SINKS, AND METHODS OF FABRICATING THE SAME

CROSS-REFERENCE TO RELATED APPLICATION

This application claims priority to and the benefit under 35 U.S.C. § 119(e) of U.S. Provisional Application No. 62/403,970 titled "ATOM AND ION SOURCES AND SINKS, AND METHODS OF FABRICATING THE SAME," filed on Oct. 4, 2016, which is herein incorporated by reference in its entirety for all purposes.

FEDERALLY SPONSORED RESEARCH

This invention was made with government support under grant No. HR0011-14-C-0115 awarded by DARPA. The U.S. government has certain rights in the invention.

TECHNICAL FIELD

Various aspects and embodiments disclosed herein relate generally to solid state atom and ion sources and sinks and to methods of fabricating the same.

BACKGROUND

Some existing approaches to introducing atoms and ions (e.g., alkali atoms and ions) into an environment from a source of same involve: heated chemical reactions using, for example, alkali sources sold by SAES Getters S.p.A. of Milan, Italy ("SAES") or Alvatec Alkali Vacuum Technologies GmbH of Althofen, Austria ("Alvatec"); using solid state atom sources; pulsed laser ablation of metal in a vacuum system; and using ovens filled with alkali metal. One example of a solid state atom source is described in U.S. Pat. No. 8,999,123. These exemplary atom and ion sources may be used to provide a controlled partial pressure of atoms in atomic sensor systems, such as atomic clocks, atomic magnetometers, and cold atom inertial systems (e.g., gyroscopes and accelerometers). Moreover, ion beams may be used to provide thrust for spacecraft, in ion beam etching, and to source ions to ion-traps for atomic sensors.

The exemplary approaches for producing atoms and ions described above suffer, however, from several drawbacks. For example, the products sold by SAES and Alvatec typically draw large amounts of current and power, are heated to a high temperature, and produce magnetic fields (from the high currents), which are all undesirable traits for most atomic sensors. In addition, undesirable gasses are produced as a by-product of use with some of these alkali sources.

Existing solid state atom sources often use shadow masked, evaporated electrodes that are inefficient due to large line-width and a low density of triple-phase boundaries (TPBs)—i.e., a low density of regions where a body of the solid state ion-conducting atom source, electrodes, and an environment into which the atoms are to be released or from which atoms are to be absorbed meet. Currently, shadow masking of electrodes can only produce wide metal fingers having widths of at least about 100 micrometers or more that trap most of the atoms to be produced in the body of the solid state atom source below the electrodes, resulting in low current efficiency. The resulting current conversion efficiency based on atoms produced per electron flowing through the system is generally less than 1%. Narrow slot shadow masks can be fabricated by, e.g., laser machining of sheet metal, or using microelectromechanical systems (MEMS) etching techniques. However, these techniques typically do not achieve interpenetration of the metal and ion-conducting phases. As such, adhesion of the metal electrodes is not optimized.

FIG. 1 shows an exemplary prior art system 10 including a solid state source 12 with metal finger electrodes 14 produced by shadow masking. The source 12 also includes a copper contact 16 that is connected to the metal finger electrodes 14 and can be connected to a voltage source. The width of the narrow metal electrode finger electrodes 14 is limited to about 130 micrometers (130 μm) by available shadow mask technology. The pictured source 12 has a diameter D of 12 millimeters (12 mm).

FIG. 2 is a schematic cross-sectional view of a system 10 as shown in FIG. 1. FIG. 2 shows a metal finger electrode 14, which serves as a cathode. The metal finger electrode has a width of $w_m$. The metal finger electrode 14 extends over a solid state ionic conductor 18, which extends over an anode 20. In operation, mobile ions, such as rubidium (Rb) ions within the solid state ionic conductor 18, migrate towards the metal finger electrode 14 under the influence of an electric field, and accumulate in a region 22 adjacent to the metal finger electrode 14 where they are neutralized. The region 22 extends beyond the edges of the metal finger electrode 14 by a distance of $t_{sc}$ on each side of the metal finger electrode 14. Atoms that arrive near the edge of the metal finger electrode 14 can evaporate into the surrounding environment, which is often a vacuum. These edge regions form TPBs 24 where the electron conductor (in this case, the metal finger electrode 14), ionic conductor 20, and empty space, also referred to herein as voids or pores, meet. Most of the mobile atoms arrive under the wide metal finger electrode 14 and are trapped due to limits on the width of the metal finger electrode 14. Furthermore, a continuous layer of the alkali element (e.g., Rb, Cs) under the metal finger electrode 14 can result in failure of the system 10, particularly if it is exposed to air and/or moisture during or after operation.

An alternative to forming metal finger electrodes on the surface of an ionic conductor with a shadow mask to fabricate an ion/atom supply/sink system is to use photolithography to create narrower interconnected lines by liftoff and/or etching. However, these surface lines generally still suffer from poor adhesion to the ionic conductor. Furthermore, many fast ionic conductors are incompatible with photoresist and developer chemistries or with processes including photolithography for defining electrodes on surfaces of the ionic conductors, since the ionic conductors, such as ceramic ion conductors, are hygroscopic.

Pulsed laser ablation typically requires the addition of a high power pulsed laser to the system, and oven sources generally consume power and cannot be easily switched on and off.

Accordingly, there is a need for an improved electrode system for solid state atom and ion sources and sinks.

SUMMARY

According to one aspect of the present disclosure, a bi-directional device is provided for generating or absorbing atoms or ions. In some embodiments, the bi-directional device comprises a solid-phase ion-conducting material, the solid-phase ion-conducting material including an element selected from the group consisting of an alkali metal, an alkaline earth metal, and a rare earth metal; a first electrode positioned on a first surface of the solid-phase ion-conducting material; a second electrode positioned on a second surface of the solid-phase ion-conducting material; a plurality of triple phase boundaries, each triple phase boundary located at an interface between the solid-phase ion-conducting material and the first electrode; and a density of the triple phase boundaries in the range of about $10^4$ m/m$^2$ to about $2\times10^7$ m/m$^2$ on the first surface of the ion-conducting material.

In some embodiments, the first electrode covers less than 10% of the first surface.

In some embodiments, the first electrode covers less than 3% of the first surface.

In some embodiments, the first electrode includes a plurality of contiguous ion-conducting particles disposed on the first surface, and the plurality of contiguous ion-conducting particles leave contiguous interstitial spaces.

In some embodiments, a largest dimension of each interstitial space is between about 0.1 microns and about 10 microns.

In some embodiments, the first electrode is positioned in a plurality of grooves in the first surface of the solid-phase ion-conducting material.

In some embodiments, the second electrode comprises one of silver and copper.

In some embodiments, the solid-phase ion-conducting material is selected from a material capable of generating or absorbing an atom or an ion.

In some embodiments, the device further comprises a temperature control device operatively connected to the solid-phase ion-conducting material.

According to another aspect of the present disclosure, a method is provided for generating or absorbing atoms or ions. In some embodiments, the method includes connecting a bi-directional device to a voltage source, the bi-directional device being capable of generating or absorbing atoms or ions, the bi-directional device comprising a first electrode positioned on and covering less than 10% of a first surface thereof and a second electrode positioned on a second surface thereof; determining whether to generate or absorb atoms or ions; selectively applying a voltage of a correct polarity to the first electrode of the bi-directional device in response to the step of determining whether to generate or absorb ions.

In some embodiments, the bi-directional device has a conversion efficiency of between one atom and five atoms per 10 electrons flowing through the first electrode.

In some embodiments, the method further comprises determining a desired partial pressure of atoms in an atomic sensor system; sensing a partial pressure of atoms in the atomic sensor system; and controlling the voltage to release atoms into or to absorb atoms from the atomic sensor system based on the sensed partial pressure of atoms in the atomic sensor system to achieve the desired partial pressure.

In some embodiments, the method further comprises directing the atoms to provide thrust for a vehicle.

In some embodiments, the method further comprises ion beam etching a surface of a workpiece, wherein controlling the voltage causes the bi-directional device to release ions.

According to another aspect of the present disclosure, a method of fabricating a bi-directional device for generating or absorbing atoms or ions is provided. In some embodiments, the method comprises selecting a solid-phase ion-conducting material comprising a material from the group consisting of an alkali metal, an alkaline earth metal, and a rare earth metal; positioning a first electrode on a first surface of the solid-phase ion-conducting material, the first electrode having a plurality of triple phase boundaries, each triple phase boundary located at an interface between the solid-phase ion-conducting material and the first electrode, and a density of the triple phase boundaries in the range of about $10^4$ m/m$^2$ to about $2\times10^7$ m/m$^2$ on the first surface of the ion-conducting material; and positioning a second electrode on a second surface of the solid phase ion-conducting material.

In some embodiments, the first electrode covers less than 10% of the first surface.

In some embodiments, positioning the first electrode on the first surface of the solid-phase ion-conducting material comprises: creating grooves within the first surface; and positioning an electrically conductive material within the grooves.

In some embodiments, selecting the solid-phase ion-conducting material comprises selecting a ceramic material and the method further comprises firing the ceramic material.

In some embodiments, the method further comprises removing a first portion of the electrically conductive material extending above an upper surface of the solid-phase ion-conducting material after positioning the electrically conductive material within the grooves such that a second portion of the electrically conductive material remains in the grooves.

In some embodiments, positioning the first electrode on the first surface of the solid-phase ion-conducting material comprises positioning a mixture of an ion-conducting powder and an electron-conducting powder on the first surface.

In some embodiments, method further comprises sintering the mixture onto the ion-conducting material.

In some embodiments, creating grooves within the first surface comprises: molding grooves into the first surface; and firing the solid-phase ion-conducting material.

In some embodiments, selecting the solid-phase ion-conducting material further comprises: selecting a first ceramic material having a first grain size and a second ceramic material having a second grain size; and positioning a layer of the second ceramic material on a layer of the first ceramic material.

In some embodiments, selecting the first ceramic material comprises selecting β" alumina.

In some embodiments, selecting the second ceramic material comprises selecting β" alumina.

In some embodiments, the method further comprises firing the first ceramic material and the second ceramic material.

In some embodiments, positioning the first electrode further comprises disposing a metal layer on the second ceramic material after firing the first ceramic material and the second ceramic material.

In some embodiments, disposing the metal layer comprises disposing the metal layer in a grid pattern by one of shadow masking, screen printing, and aerosol jet printing.

In some embodiments, disposing the metal layer further comprises disposing the metal layer at an angle relative to a line normal to an upper surface of the solid-phase ion-conducting material.

In some embodiments, selecting the solid-phase ion-conducting material further comprises depositing a ceramic material via electrophoresis over a carbon mold.

In some embodiments, the method further comprises sintering the ceramic material by heating the ceramic material and the carbon mold in an oxidizing atmosphere; and removing the carbon mold.

DESCRIPTION OF THE FIGURES

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION

Various aspects and embodiments disclosed herein feature an electrode system for solid state atom or ion sources and sinks. In one embodiment, a porous electrode region that includes or consists of a mix of an electron conductor, an ion conductor, and connected porosity is employed. The porous region or porous layer may be formed on one side or two opposing sides of the ion conductor. In various embodiments, a device disclosed herein improves upon currently available solid state atom or ion sources and sinks, as it has improved current efficiency, and electrodes which exhibit improved adhesion to an ion conductor, and improved durability as compared to currently available solid state atom or ion sources and sinks. The deficiencies of currently available solid state atom or ion sources and sinks are overcome as a result of an increased density of TPBs and the inter-connectedness of the ion and electron conductors in the device.

Aspects and embodiments of the device disclosed herein feature several advantages over current technology, as it allows for the generation and absorption of alkali metals at low power, low current, and low temperature. For example, aspects and embodiments of the device disclosed herein may operate at a temperature below about 200° C. Additionally, aspects and embodiments of the device disclosed herein are compatible with high vacuum systems. In some embodiments, the device can quickly generate or absorb alkali atoms or ions in vacuum systems, presenting a speed advantage over atom or ion sources and sinks currently available on the market.

Figure 1:
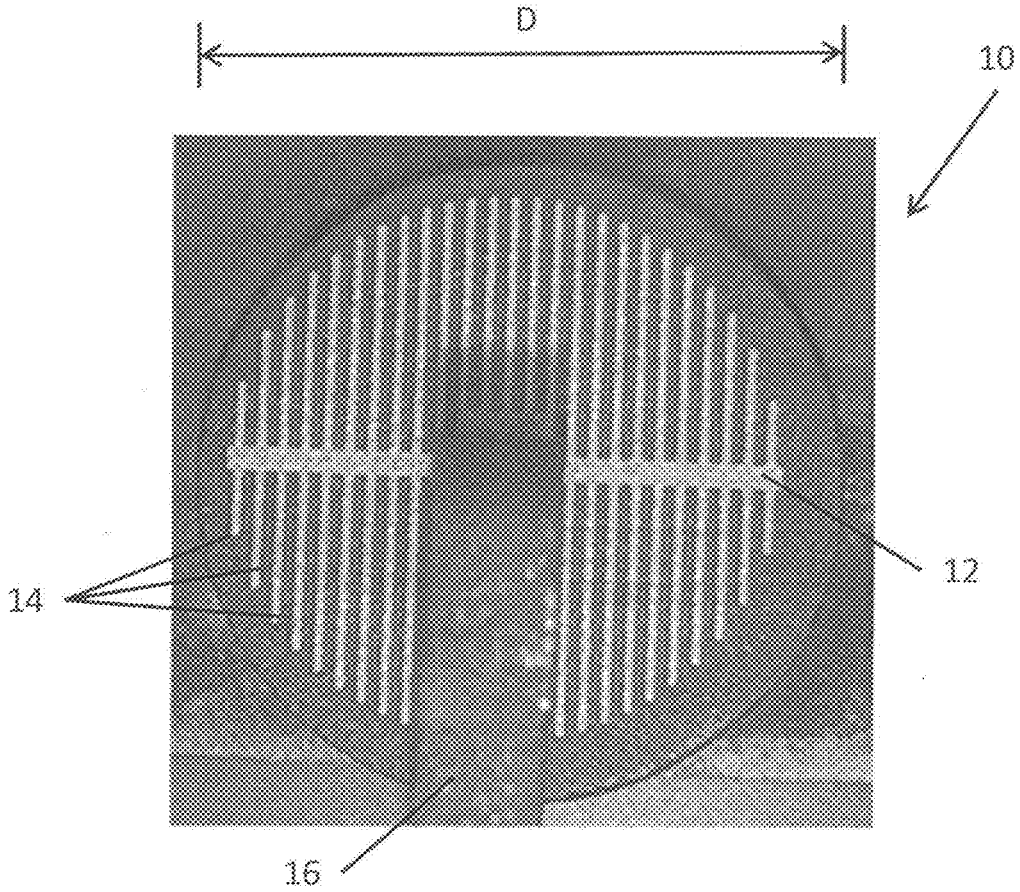
FIG. 1 (Prior Art)
FIG. 1 shows an exemplary prior art electrode system.
Figure 2:
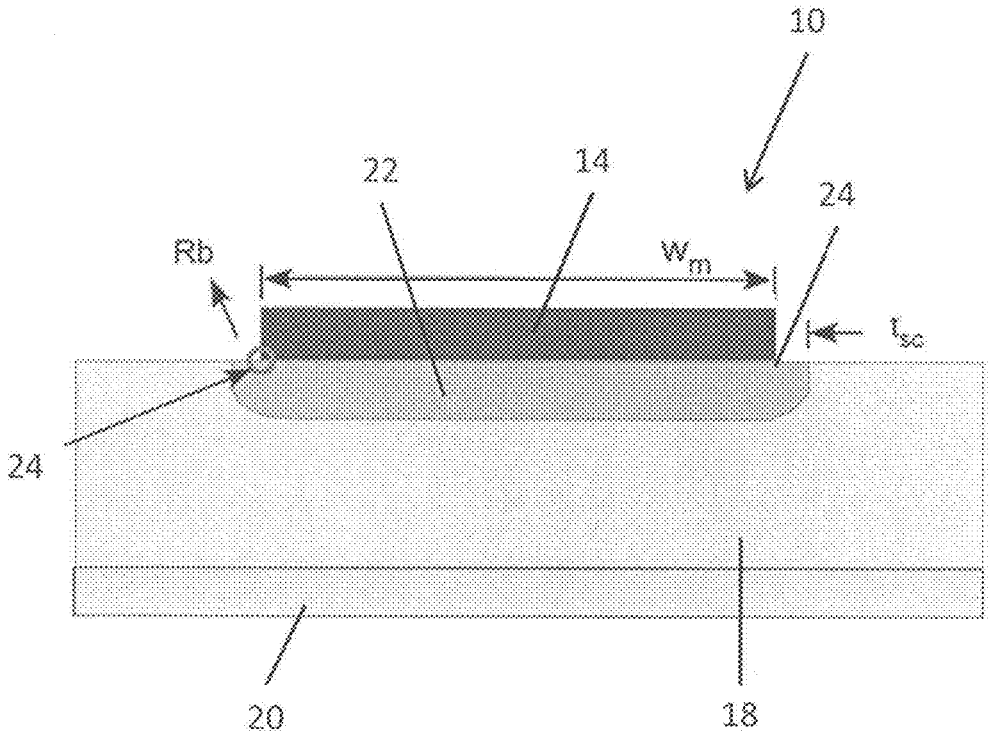
FIG. 2 (Prior Art)
FIG. 2 shows a schematic cross-sectional view of the system of FIG. 1.

Aspects and embodiments disclosed herein improve upon currently available solid state atom or ion sources and sink systems, such as those described with reference to FIGS. 1 and 2, by employing micro-structured, inter-penetrating electron-conducting and ion-conducting phases that increase reliability and adhesion between the electron-conducting and ion-conducting phases. Simply decreasing the width of the metal fingers of the electrode illustrated in FIGS. 1 and 2 by, for example, forming the metal finger electrode by photolithography or by utilizing a shadow mask with finer slots may increase the current efficiency of the device, but does not allow for the interlocking of the electron-conducting and ion-conductive phases, which is desirable for increasing adhesion between the electron-conducting and ion-conducting phases and durability of the device.

Aspects and embodiments disclosed herein may increase the current efficiency of the resulting device as compared to that of previously known devices through the use of a micro-structured porous surface layer that combines an ion conductor, an electron conductor, and voids.

According to one aspect of the present disclosure, a bi-directional device for generating and/or absorbing atoms or ions is provided. In some embodiments, the bi-directional device comprises a solid-phase ion-conducting material (ion-conducting material), a first electrode, such as a cathode, positioned on a first surface of the solid-phase ion-conducting material, and a second electrode, such as an anode, positioned on a second surface of the ion-conducting material.

Embodiments of the bi-directional device of the present disclosure can include any materials used for solid state electrochemical alkali sources and sinks. Embodiments of the bi-directional device of the present disclosure can be made of materials described in "Solid State Electrochemical Alkali Sources for Cold Atom Sensing" (J. Bernstein, A. Whale, J. Brown, C. Johnson, E. Cook, L. Calvez, X. Zhang and S. Martin, Technical Digest, Solid-State Sensors, Actuators and Microsystems Workshop, Hilton Head Island, Jun. 5-9, 2016). Materials described in U.S. Pat. No. 8,999,123 can also be used in embodiments of the bi-directional device of the present disclosure.

The solid-phase ion-conducting material may be any material that is useful for conducting an ion. The solid-phase ion-conducting material may be capable of generating or absorbing atoms or ions. The solid-phase ion-conducting material may be non-conductive to electrons. In some embodiments, the solid-phase ion-conducting material comprises an element selected from the group consisting of an alkali metal, an alkaline earth metal, and a rare earth metal. In some embodiments, the solid-phase ion-conducting material is a doped glass. In some embodiments, the solid-phase ion-conducting material is useful for conducting Cesium (Cs) ions or Rubidium (Rb) ions, among others. In some embodiments, the solid-phase ion-conducting material is useful for conducting aluminum or mercury.

The solid-phase ion-conducting material may provide alkali atoms or ions, as well as atoms or ions of other elements such as alkaline earth elements (e.g., Strontium (Sr)) or rare earth elements. Alternatively or additionally, in some embodiments, the device is adapted for use as a solid state atom or ion sink. In some embodiments, the solid-phase ion-conducting material includes β" alumina. β" alumina is typically manufactured as a sodium compound. However, other alkali or alkaline earth or rare earth elements can be substituted for the sodium by an ion exchange process, thereby creating, e.g., Rb substituted β" alumina or Cs substituted β" alumina.

The solid-phase ion-conducting material may be between about 0.1 millimeters and about 10 millimeters thick in some embodiments, depending on how many atoms or ions a device including the solid-phase ion-conducting material is intended to release and/or absorb. The thickness of the solid-phase ion-conducting material can be selected based on the intended use of the bi-directional device. The greater the volume of the solid-phase ion-conducting material, the greater capacity it has to store ions. A bi-directional device that is intended to release and/or absorb a greater quantity of ions may include a larger volume of ion-conducting material than a bi-directional device that is intended to release and/or absorb a lesser quantity of ions.

Chalcogenide glasses based on sulfur, selenium, or tellurium doped with alkali-halides have high ionic mobility, and may be used in or as the solid-phase ion-conducting material. Chalcogenide glasses are also less hygroscopic than oxide glasses that have high alkali content. Sodium β" alumina is a ceramic phase of $Al_2O_3$ and sodium with high ionic mobility. Another alkali can be substituted in place of the sodium via high temperature diffusion. β" alumina has a high ionic conductivity at a low temperature relative to other ceramics and relative to doped glasses. β" alumina is also useful because of its durability and its availability.

When currents in the microamp to milliamp range are passed through chalcogenide doped with cesium, rubidium, and/or rubidium-β-alumina, the glass produces a high purity alkali by electrolysis. When the polarity of voltage supplied from a voltage source to the first and second electrodes is reversed, the doped glass can absorb alkali. The doped chalcogenide glass is useful for generating ions when a first electrode is a cathode and a second electrode is an anode. Alternatively, the doped glass is useful for absorbing ions when the first electrode is an anode and the second electrode is a cathode.

β" alumina has a higher electrical conductivity than selenide glass doped with cesium or rubidium. Selenide glass doped with cesium or rubidium has an electrical conductivity that varies with the alkali concentration. The respective activation energies for the Rb and Cs doped selenide glass and β" alumina are similar. The higher the electrical conductivity of an ion-conducting material is, the lower the voltage and material temperature that may be required to operate a device including the ion-conducting material to release or absorb a desired amount of ions or atoms and/or affect a rate of release or absorption of ions or atoms. Thus, high electrical conductivity ion-conducting materials are desirable for applications in which low voltage operation is desired.

The electrodes of the bi-directional device of the present disclosure may be formed of metal, carbon, or any other conductive material. The electrodes of the bi-directional device of the present disclosure may include electron-conducting material that is non-conductive to ionic species.

Although reference is made herein to an anode and a cathode, in some embodiments, the bi-directional device includes a first electrode and a second electrode, which each may be an anode or a cathode, depending on the polarity of the voltage applied to the first electrode and the second electrode.

The cathode may comprise or consist of a metal, for example, silver and/or copper or any metal or alloy that can be used in an electrode. In some embodiments, the cathode covers less than about 10% of a first surface of the solid-phase ion-conducting material though which ions and/or atoms are released and/or absorbed (a "first surface") in a device as disclosed herein. In some embodiments, the cathode covers less than about 3% of the first surface of the solid-phase ion-conducting material. The cathode supplies electrons for neutralizing the alkali ions that migrate to the first surface of the ion-conducting material.

The anode may comprise or consist of a metal, for example, silver and/or copper, or any metal or alloy that can be used in an electrode.

In some embodiments, the anode is a second electrode that can act as a cathode when the polarity of the voltage at the first and second electrode is reversed. In some embodiments, the anode covers less than about 10% of a second surface of the solid-phase ion-conducting material in a device as disclosed herein. In some embodiments, the anode covers less than about 3% of the second surface of the solid-phase ion-conducting material. The second surface may be a surface opposite the first surface.

The anode may supply ions into or absorb ions from the solid-phase ion-conducting material, and may have a volume of about one quarter that of the solid-phase ion-conducting material. For example, if the solid-phase ion-conducting material has the same length and width as the anode, the anode may have a depth that is about one fourth the depth of the solid-phase ion-conducting material. In some embodiments, the solid-phase ion-conducting material may have a circular profile when viewed from above. In some embodiments, the circular profile may have a diameter in the range of from about 1 centimeter to about 10 centimeters, although embodiments disclosed herein are not limited to having these dimensions.

The anode may serve as an ion source for the solid-phase ion-conducting material. The size of the anode can be configured based on the needs of a particular implementation. In some embodiments, the anode can provide a mass of ions equal to about 25% of its total mass. The anode may be a solid that has a surface that is in direct engagement with the solid-phase ion-conducting material.

Each of the anode and the cathode may be positioned on the solid-phase ion-conducting material to allow for a durable connection to extend the life of the bi-directional device. As used in relation to positioning the anode or positioning the cathode, the term "positioning" may include any manufacturing method useful for adhering the anode and/or the cathode to the ion-conducting material. For example, positioning may include providing an anode or cathode having an electron conducting phase that interpenetrates an ion-conducting phase of the ion-conducting material to increase reliability and adhesion of the electron-conducting phase to the ion-conducting material. Positioning may include placing metal cathode or anode material in a groove in the ion-conducting material. Positioning may include depositing grains of electron-conducting material on the ion-conducting material.

To improve adhesion of an electrode to the solid solid-phase ion-conducting material, an adhesion layer including a thin layer, for example, a layer of less than a micrometer in thickness, of titanium or chromium can be applied between the solid-phase solid ion-conducting material and the respective electrode. In some embodiments, there is no adhesion layer between the solid-phase ion conducting material and the electrode that forms the anode. In some embodiments, there is no adhesion layer between the solid-phase ion conducting material and the electrode that forms the anode, and the anode is made of copper or silver.

A plurality of triple-phase boundaries is formed at an interface between the solid-phase ion-conducting material, the cathode, and the environment in a system in which the device is disposed. In some embodiments, triple-phase boundaries are located at edges of contiguous interstitial spaces defined by a plurality of contiguous conducting particles (contiguous grains) in the cathode. As the term is used herein "contiguous conducting particles" are conducting particles that are each electrically connected to one another. In some embodiments, the largest dimension (such as a length) of each interstitial space is between about 0.1 microns and about 10 microns. In some embodiments, the triple-phase boundaries are located at edges of grooves in the ion-conducting material. For example, in some embodiments, the cathode includes a plurality of indentations, such as grooves or channels, positioned on a surface of the ion-conducting material. In some embodiments, the cathode includes a metal disposed in each indentation (such as in each groove or in each channel). In such embodiments, triple-phase boundaries are formed at an interface between an outer edge of the ion-conducting material and an outer edge of the metal.

In some embodiments, the anode and/or cathode has a high density of triple-phase boundaries. The density of the triple-phase boundaries can be measured as a number or a total length of triple-phase boundaries per unit of surface area of the ion-conducting material. In some embodiments, the density of triple-phase boundaries can be measured as a number or total length of triple-phase boundaries per unit of length of a surface of the ion-conducting material.

The density of the TPBs for a square array of grooves each having width w surrounding square mesas of width a on the upper surface of the solid-phase ion-conducting material is $4a/(a+w)^2$. The TPB density for a spherical particle having a radius r, where one hemisphere of the particle is coated with a metal layer, is 2/r.

For example, in an embodiment of the device with a square array of grooves that are 1 μm to 5 μm wide and spaced apart by 1 μm to 10 μm, a density of triple-phase boundaries would be between 100,000 and 1,000,000 in the units of $meters^{-1}$ (meters of triple phase boundaries/$meter^2$ of surface area of ion-conducting material).

In an embodiment of the device with a porous media with circular grains having a grain size between 0.1 μm and 10 μm, the ratio of perimeter to area of the grains, the density of the TPBs is between $2\times10^5$ and $2\times10^7$ meter/$meter^2$. Smaller grains in a porous solid (e.g. 0.1 μm) yield a higher density of TPBs compared to the TPB density associated with micro-molding, assuming the micro-mold is limited to 1 μm dimensions or larger. In some embodiments, the density of TPBs is between $10^4$ and $2\times10^7$ meters/$meter^2$. Such TPB densities are not achievable with previously known shadow mask electrode formation technologies due to the limits on electrode width that may be formed via a shadow mask. Ion-conducting glasses useful in the devices disclosed herein are typically not compatible with methods of forming thin electrodes exhibiting acceptable adhesion to the ion-conducting glasses via photolithographic techniques as used in the semiconductor industry and thus TPB densities achievable with the devices and methods disclosed herein would not be achievable with previously known photolithographic electrode formation methods.

In some embodiments, the device includes a temperature control device. In some embodiments, the temperature control device senses a temperature of the ion-conducting material, the anode, and/or the cathode. In some embodiments, the temperature control device is operatively connected to the ion-conducting material. The temperature control device can adjust the temperature of the bi-directional device during operation of the bi-directional device. The temperature control device may include a resistive heater, or could be heated by a laser or other optical source. The temperature control device may include a ceramic heater and a thermocouple. Some embodiments of the bi-directional device of the present disclosure operate at temperatures below about 200° C. Some embodiments of the bi-directional device of the present disclosure operate at temperatures between about 50° C. and about 120° C.

Some embodiments of the bi-directional device may operate with a current between about 1 micro-amp and about 100 micro-amps. By controlling the voltage and/or current supplied to the electrodes, the output of atoms and/or absorption of atoms of the bi-directional device is controlled.

Another aspect of the present disclosure relates to a method of generating or absorbing ions. In some embodiments, a method of generating or absorbing ions includes connecting a bi-directional device to a voltage and/or current source. The bi-directional device is capable of releasing or absorbing atoms and ions. The bi-directional device can be any bi-directional device disclosed herein. In some embodiments, the method includes determining whether to generate or absorb atoms and selectively applying a voltage of the correct polarity to a first electrode and a second electrode of the bi-directional device in response to the step of determining whether to generate or absorb atoms.

Embodiments of the bi-directional device operate at low power compared to currently available solid state atom/ion supply/absorption devices. In some embodiments, the voltage source may provide a voltage of, for example, about 10 volts or less, between the anode and cathode of the bi-directional device. In some embodiments, the current through the anode and cathode may be about 7 microamps or less.

The bi-directional device of the present disclosure has a high conversion efficiency compared to currently available solid state atom/ion supply/absorption devices. In some embodiments, the bi-directional device has a conversion efficiency of generating or absorbing between one atom (or ion) and five atoms (or ions) per ten electrons flowing through the cathode. One atom (or ion) absorbed or released per ten electrons flowing through the cathode corresponds to a 10% conversion efficiency level. Five atoms (or ions) absorbed or released per ten electrons flowing through the cathode corresponds to a 50% conversion efficiency level.

Determining whether to generate or absorb atoms or ions may be based on a sensed partial pressure of atoms or ions in a contained system surrounding the bi-directional device. In some embodiments, the contained system may be a vacuum chamber that contains the bi-directional device therein. In some embodiments, the contained system may be an atomic sensor system. The method may include sensing a partial pressure of ions in an atomic sensor system, and controlling the current that is directed through the cathode to release ions into the atomic sensor system or to absorb ions from the atomic sensor system based on the partial pressure of ions in the atomic sensor system. Thus, the bi-directional device may be useful for achieving and maintaining a desired partial pressure of ions in a contained system.

The bi-directional device can be incorporated into various systems. In some embodiments, the method includes directing ions to provide thrust for a vehicle. The solid state device of the present disclosure is particularly useful for space vehicles, in which weight restrictions and dimensional constraints limit the weight and size of components that can be included in the vehicle. In some embodiments, the method includes controlling the current to cause the solid state ion source to release ions for ion beam etching a surface of a workpiece.

Another aspect of the present disclosure is related to a method of fabricating a bi-directional device for generating or absorbing ions. In some embodiments, the method includes selecting a solid-phase ion-conducting material comprising a material from the group consisting of an alkali metal, an alkaline earth metal, and a rare earth metal; positioning a cathode on a first surface of the ion-conducting material, the cathode covering less than about 10% of the first surface; and positioning an anode on a second surface of the ion-conducting material.

In some embodiments, selecting a solid-phase ion-conducting material can include selecting a material, such as glass that is doped with an alkali metal, an alkaline earth metal, and/or a rare earth metal, as discussed above. In some embodiments, selecting a solid-phase ion-conducting material can include selecting an ion-conducting material that consists of an alkali metal, an alkaline earth metal, and/or a rare earth metal.

In some embodiments, selecting the solid-phase ion-conducting material includes selecting a ceramic material and firing the ceramic material. Selecting the solid-phase ion-conducting material may include selecting a ceramic material and depositing the ceramic material via electrophoresis over a carbon mold. Some methods may include heating the ceramic material and the carbon mold in an oxidizing atmosphere, thereby sintering the ceramic material, and then removing the carbon mold.

In some embodiments, positioning the cathode on a first surface of the solid-phase ion-conducting material includes positioning the cathode on the first surface such that the cathode covers less than about 3% of the first surface. In some embodiments, an anode may be positioned on a second surface of the ion-conducting material such that the anode covers less than 3% of the second surface.

Positioning the cathode on the first surface of the ion-conducting material can include one or more manufacturing method or fabrication method, as discussed above. In some embodiments, positioning the cathode on the first surface of the solid-phase ion-conducting material includes creating grooves within the first surface of the solid-phase ion-conducting material, and positioning a metal or other conductive material within the grooves.

The grooves may be pressed, stamped, machined, and/or manufactured using another technique. In some embodiments, creating grooves within the first surface of the solid-phase ion-conducting material includes molding the grooves into the first surface. In some embodiments, creating grooves within the first surface includes firing the ion-conducting material after molding grooves into the first surface of the ion-conducting material. In some embodiments, the grooves may be between about 1 μm and about 5 μm wide, and spaced apart by about 1 μm to about 10 μm.

In some embodiments, the method further includes removing a first portion of the metal after positioning the metal within the grooves of the ion-conducting material such that a second portion of the metal remains in the grooves. Removing the first portion of the metal may be performed by any appropriate method, such as polishing the metal, grinding the metal, using electrical discharge machining, or by performing another machining method. In some embodiments, the first portion of the metal is the metal that extends above an upper surface of the solid-phase ion-conducting material. In some embodiments, removing the first portion of the metal exposes the upper (first) surface of the ion-conducting material and no metal remains on the upper surface of the ion-conducting material above the grooves. TPBs remain at the edges of the grooves, where an edge of the metal extends adjacent an edge of the groove on an outer surface of the bi-directional device.

In some embodiments, an electrically conductive material other than or in addition to a metal can be disposed in the grooves.

In some embodiments, positioning the cathode on the first surface of the ion-conducting material includes positioning a mixture of an ion-conducting glass or ceramic powder and an electron-conducting powder on the first surface. In some embodiments, the method further includes sintering the mixture onto the ion-conducting material.

In some embodiments, positioning the cathode on the first surface of the solid-phase ion-conducting material may include selecting a first glass or ceramic material having a first grain size and a second glass or ceramic material having a second grain size, the second grain size being greater than the first grain size; positioning the first glass or ceramic material on the first surface of the ion-conducting material; and positioning the second glass or ceramic material on the first glass or ceramic material. In some embodiments of the device, the ion-conducting material comprises the first glass or ceramic material. In some embodiments, the ion-conducting material of the device comprises the first glass or ceramic material and the second glass or ceramic material. In some embodiments, the ion-conducting material of the device consists of the first glass or ceramic material and the second glass or ceramic material. The first grain size may be less than about 0.1 μm. The second grain size may be between about 0.1 μm and about 10 μm. Grain size may refer to an average diameter or maximum diameter or other characteristic dimension of the grains. The first ceramic material and the second ceramic material may each be β" alumina. The first and second ceramic material may be provided as a green ceramic material that is then fired. In some embodiments, after firing the first ceramic material of the cathode and the second ceramic material of the cathode, a metal layer is positioned over the second ceramic material of the cathode. The metal layer may be a metal film or a metal powder. The metal layer may include any metal that is useful in a cathode. The metal layer may be positioned in a pattern of lines, in a grid pattern, or in another geometrical shape. In some embodiments, positioning the metal layer includes disposing the metal in a grid pattern by one of shadow masking, screen printing, and aerosol jet printing. TPBs are located at edges of the metal layer on the grains of the first ceramic material and edges of the metal layer on the grains of the second ceramic material. This structure yields a high density of TPBs on the bi-directional device. The grains and the metal layer are interpenetrating, so the ion-conducting phase and the electron-conducting phase are interpenetrating. This increases adhesion of the metal layer to the solid-phase ion-conducting material, and also increases the conversion efficiency of the bi-directional device because of the high density of TPBs.

In some embodiments, forming the solid-phase ion-conducting material may include selecting a first ceramic material having a first grain size and a second ceramic material having a second grain size, the second grain size being greater than the first grain size; forming an internal portion of a body of the solid-phase ion-conducting material with the first ceramic material; and positioning the second ceramic material on the first ceramic material. The first grain size may be less than about 0.1 μm. The second grain size may be between about 0.1 μm and about 10 μm. The first ceramic material and the second ceramic material may each be β" alumina. The first and second ceramic material may be provided as a green ceramic material that is then fired. Firing of the first and second ceramic material may result in the first ceramic material being sintered into a substantially void-free body, while the second ceramic material forms a layer or coating including voids defined between sintered grains of the second ceramic material on the substantially void-free body.

Figure 3:
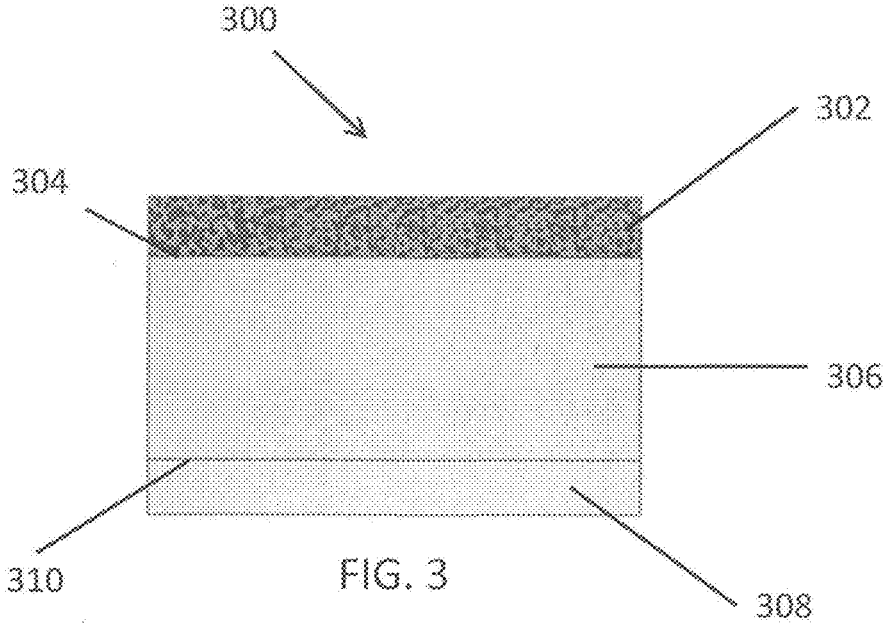
FIG. 3 shows a solid state atom or ion source with a porous cathode.

FIG. 3 shows a cross section of a portion of an embodiment of a solid state bi-directional device 300 in which a cathode having a porous surface layer 302 is formed on a first side 304 of a solid state ion-conducting material 306. The porous surface layer may include interpenetrating ion-conducting material and electron-conducting material. The electron-conducting material may be contiguous. An anode 308 is formed on a second side 310 of the solid state ion-conducting material 306.

In some embodiments, the porous surface layer 302 may be present on a first surface 304 of the solid-phase ion-conducting material, as illustrated in FIG. 3. In other embodiments, the porous surface layer 302 may be present on both sides 304, 310 of an ion-conducting material. In some embodiments, a porous surface layer may be present on another ion-conducting surface in the device.

In one embodiment, the electron conductor of the porous surface layer covers less than about 75% of the device surface on which the porous surface layer is located. In other embodiments, the electron conductor of the porous surface layer covers less than 50%, less than 35%, less than 20%, less than 10%, less than 5%, or less than 3% of the device surface on which the porous surface layer is located. As the fraction of the surface covered by the electron conductor increases, it increasingly blocks the escape of atoms/ions (e.g., alkali) and reduces the faradaic efficiency for atom/ion (e.g., alkali) generation. Where the device is used as an alkali absorber, it is desirable to have the impinging alkali atoms land on the ion conductor. Any atom that lands on the electron conductor would first have to diffuse to a TPB to lose an electron and become ionized to enter the lattice of the solid-phase ion-conducting material. Decreasing the fraction of the surface covered by the electron conductor thereby improves the efficiency of the atom and ion sources and sinks described herein. Increasing the density of TPBs improves the efficiency of the atom and ion sources and sinks described herein.

By employing a porous, mixed phase electrode with small particle sizes, an improved electrode with a high density of TPB regions may be obtained. One embodiment is illustrated in FIG. 3. In this embodiment, the device is configured to function as either a solid state source or a solid state sink. In some embodiments, the pore size and particle size (for example, average diameter) in the porous electrode are between about 0.1 μm and about 10 μm.

Figure 4:
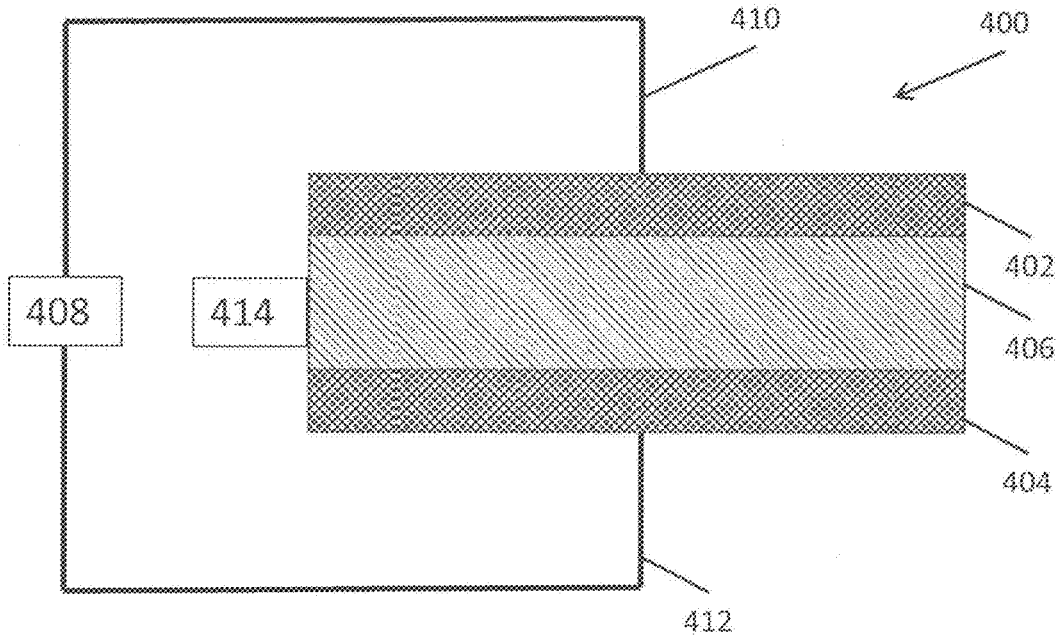
FIG. 4 shows an ion source/sink with a porous layer on both an upper and lower side.

FIG. 4 shows an embodiment of a solid state bi-directional device 400 with a first porous layer 402 and a second porous layer 404 each on a surface of an ion-conducting solid 406 that includes or consists of an ion-conducting material. In this embodiment, one surface serves as an alkali emitter, while the other surface serves as an alkali absorber. For example, the device illustrated in FIG. 4 may serve as an electrically operated bi-directional pump for alkali ions. A voltage source 408 is connected to a lead 410 that is connected to an electron conductor embedded in the first porous layer 402. The voltage source 408 is also connected to a lead 412 that is connected to an electron conductor embedded in the second porous layer 404. The voltage source 408 can thus provide a current through the device 400.

The leads 410, 412 may be made of a conductive material. Silver and copper are good conductors, and may be used in the leads 410, 412. In some embodiments, the leads 410, 412 include inert materials that do not react with the alkali. For example, one or more lead may be made of aluminum. One or more leads may be made of gold or platinum.

A temperature controller 414 may be provided in thermal communication with the solid state bi-directional device 400. The temperature controller 414 may include a source of heat, for example a resistive heater and a temperature monitor, for example, a thermocouple. A power source and circuitry for controlling the temperature controller 414 may be provided internal to the temperature controller, or remote from the source of heat and/or temperature monitor.

The exemplary devices depicted in FIGS. 3 and 4 may be manufactured using one of several exemplary methods described below. These described methods of manufacture present several advantages over existing methods, as they allow for the creation of a porous cathode and/or anode with a high density of electron conductor, ion conductor, and voids (i.e., a high density of TPBs). None of the methods described below involve driving a chemical reaction by heating with very high current, power or temperature, or create unnecessary magnetic fields or impurity gasses, as do existing methods of manufacture.

As described below, the method of manufacturing a porous, mixed phase electrode region depends on the material of the solid state ionic conductor and its melting point.

Example Method 1

Because glasses have softening points (which crystalline ceramics do not have) generally at a low temperature, different techniques for porous layer formation are available, such as molding or hot pressing a porous metal or carbon electrode into the surface of a glass body. Porous metal electrodes can be made using well known powder metallurgy methods.

Figure 5A:
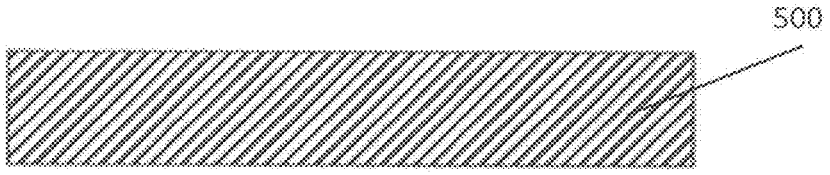
FIGS. 5A-5H show steps of a method of forming fine featured metal conductive traces in a glass body.
Figure 5B:
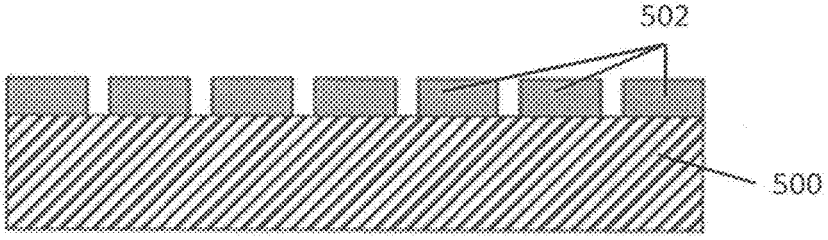
Figure 5C:
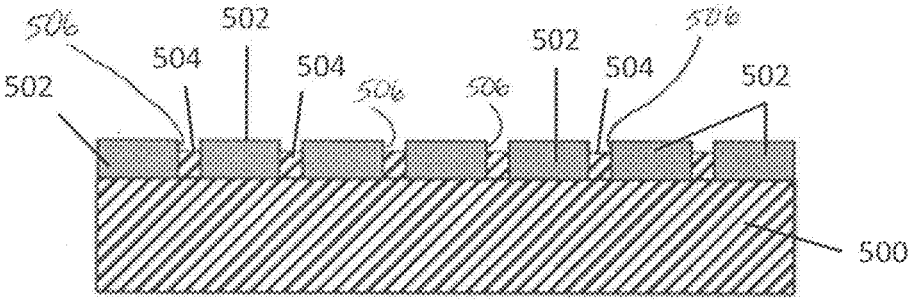
Figure 5D:
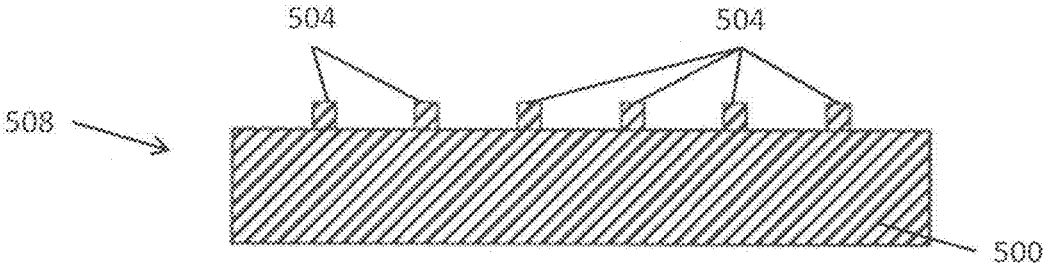
Figure 5E:
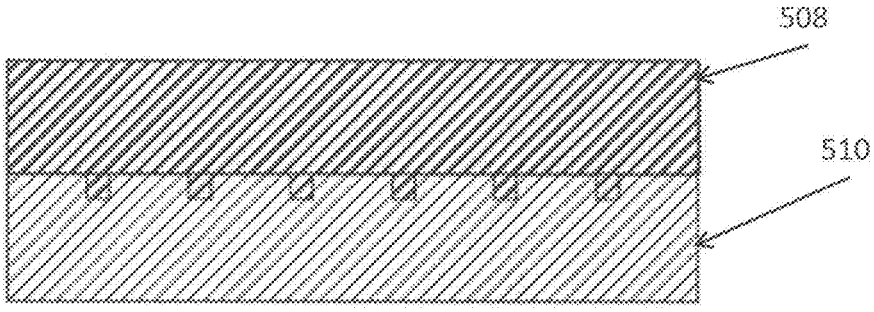
Figure 5F:
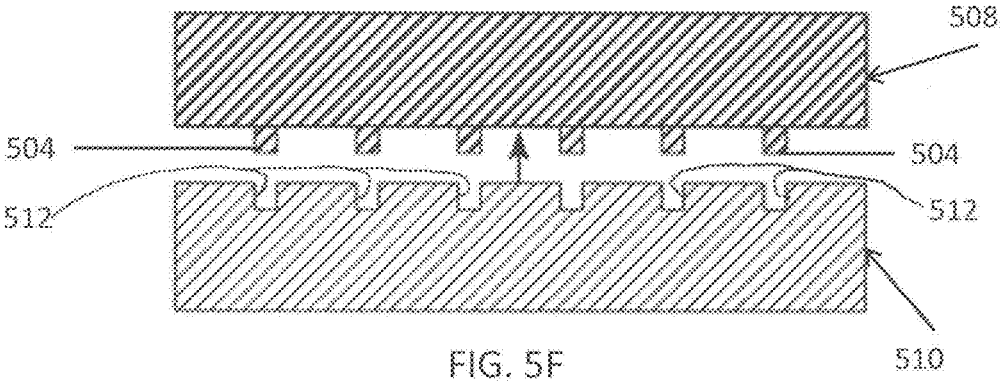
Figure 5G:
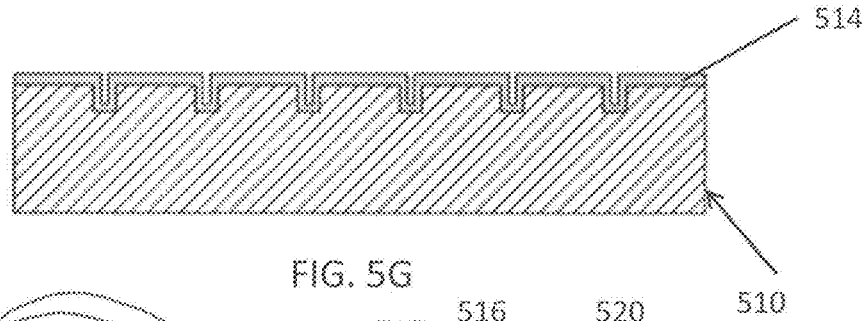
Figure 5H:
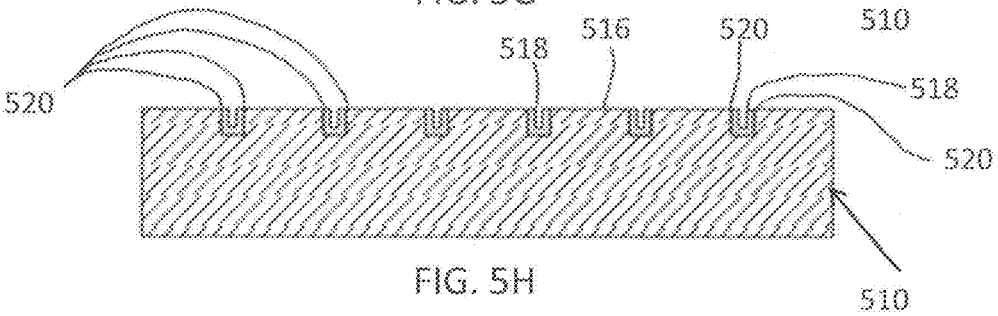

In one embodiment, a micro-mold is used to press an array of holes or a network of channels into a surface of an ion-conducting glass. Following a sputter or evaporation step, which deposits a metal layer on the surface of the glass, the top surface of the metal is polished off, leaving a continuous network of metal lines along the bottom and sides of the glass channels. FIGS. 5A-5H shows the steps involved in forming a mold, molding the glass, and forming the electrode. In FIG. 5A, the starting mold substrate 500 is shown. In some embodiments, this is a metal plate with a polished surface (e.g., a nickel alloy). In FIG. 5B, a layer of photoresist 502 is applied to the starting mold substrate 500, exposed, and developed to open a pattern where the mold metal is to be electroplated. In FIG. 5C, metal (e.g. Ni, Ni—Co or another metal or alloy) 504 is electroplated into the openings 506 in the photoresist 504. The openings 506 are longitudinally extending openings in the end view FIG. 5C. In FIG. 5D, the photoresist 502 has been removed, leaving the metal 504 on the starting mold substrate 500. The metal 504 is in the form of longitudinally extending protrusions extending upwardly from the substrate 500. The resulting mold 508 comprises the metal 504 and the substrate 500. In FIG. 5E, the mold 508 is placed on a glass body 510 in a furnace for a time and temperature suitable to press the mold into the ion-conducting glass 510. In FIG. 5F, the mold 508 has been removed from the glass 510, leaving longitudinally extending grooves 512 in the glass 510. In FIG. 5G, a metal conductive layer 514 has been deposited on the upper surface of the molded glass 510 so that the metal conductive layer 514 extends into the grooves 512. In FIG. 5H, a surface layer of metal conductive layer 514 that extends above the upper surface 516 of the glass 510 has been removed (e.g., by polishing) leaving a network of fine-featured metal lines 518 inside the glass grooves 512 produced by molding. This process produces a high density of fine metal lines 518 embedded in the glass, whose surface boundaries form TPBs 520 capable of emitting or absorbing alkali or other mobile metals. In this method, the longitudinally extending borders between the upper edges of the U-shaped grooves 512 and the metal lines 518 form the TPBs.

Figure 6:
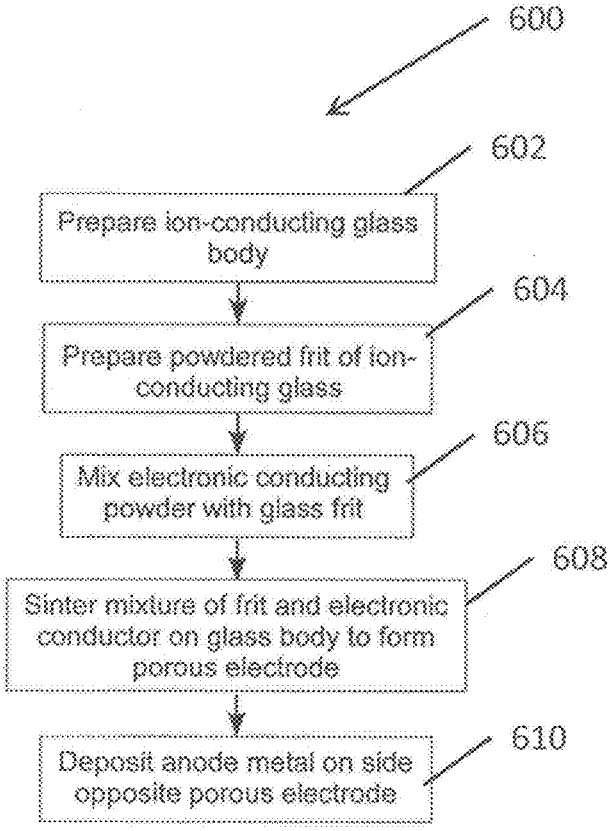
FIG. 6 is a flowchart of a method of forming a solid state device.

In some embodiments, an alternate technique for use with glass is to melt a mixture of a glass powder (frit) and an electron conducting powder to form a porous interpenetrating phase where both ionic and electronic phases are continuous while retaining porosity. The electron conducting powder may be a metal, an alloy, or carbon, among others. This mixed conductor may be formed on the surface of a solid glass disc or other shaped substrate. A flow chart describing the steps in forming a mixed phase electrode is shown in FIG. 6. In the method 600, an ion-conducting body is prepared at 602. At 604, a powdered frit of ion-conducting glass is prepared. At 606, the electron conducting powder is mixed with glass frit. At 608, the mixture of frit and electron conducting powder is sintered on the glass body to form a porous electrode. At 610, a metal anode is deposited on a side of the glass opposite the porous electrode.

Figure 7:
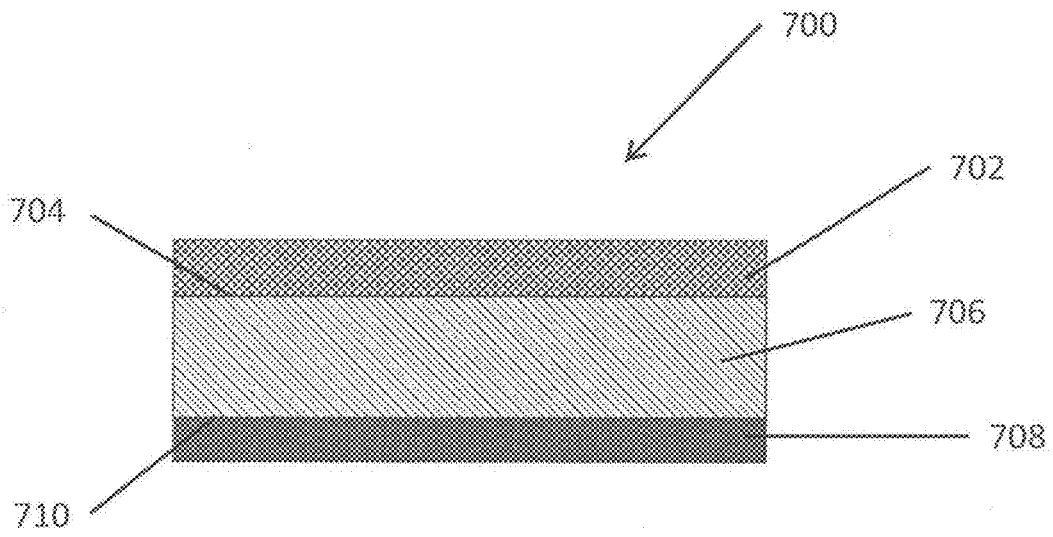
FIG. 7 shows a cross-sectional view of an ion-conducting bi-directional device.

An illustration of an exemplary device fabricated using the method 600 of FIG. 6 is shown in FIG. 7. In this embodiment, the device 700 is fabricated with a non-blocking electrode 708, typically copper (Cu) or silver (Ag). The device 700 includes a porous cathode 702 that includes a mixture of frit and electron conducting powder that has been sintered. The porous cathode 702 is positioned on a first side 704 of an ion-conducting glass 706. An anode 708 is positioned on a second side 710 of the ion-conducting glass 706.

Example Method 2

In some embodiments, ceramics such as β" alumina may be used for an ion-conducting body of a device as disclosed herein. However, the melting point of β" alumina (T≈2000° C.) is too high to conveniently hot press a metal electrode into the surface. In one embodiment, a porous surface layer is formed by appropriately choosing a particle size of the β" alumina during formation of the green (unfired) ceramic. It is well known to ceramists that the time and temperature necessary to achieve full density from a green body (unfired ceramic) is a function of the particle size, with coarser powders taking longer to sinter to full density.

In this embodiment, the ion-conducting body, or substrate, of the green ceramic is made of a fine-grained powder, which sinters to near full density. A surface layer made of larger grain sizes is deposited on the fine grained layer, resulting in a porous surface layer after firing.

Figure 8:
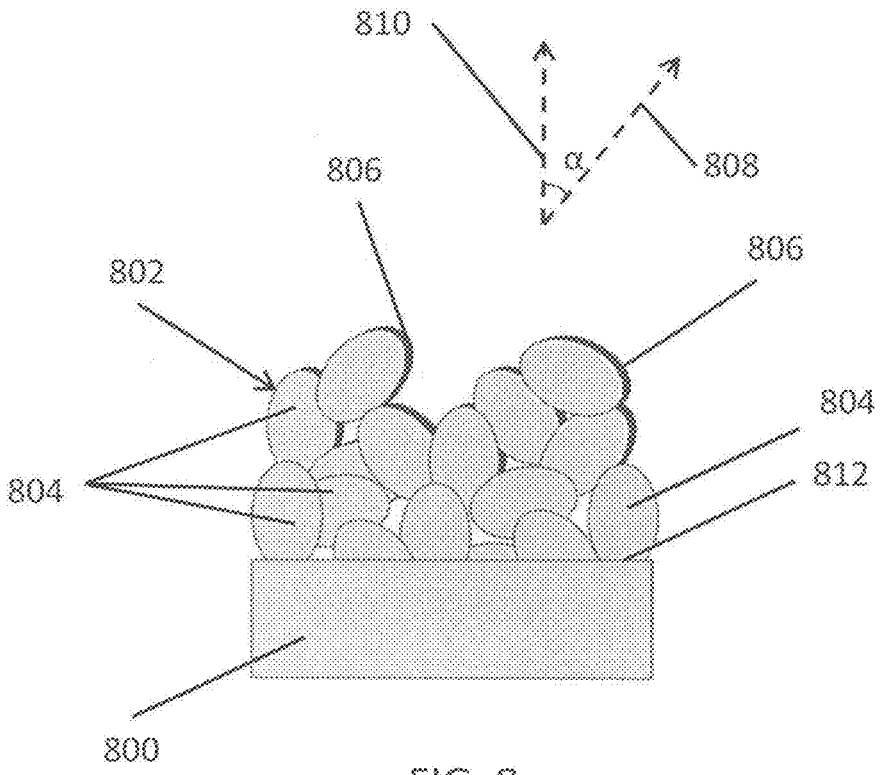
FIG. 8 shows a cross-sectional view of a portion of an ion-conducting ceramic with a porous surface layer.

After the firing step, the electrode, or electron conductor, is created through a metal deposition step (e.g., evaporation), which deposits a continuous thin film of metal down onto the surface layer, providing a high density of microstructured TPBs. FIG. 8 shows an illustration of a solid, β" alumina substrate 800 fabricated from fine-grained particles, a porous layer 802 formed of large-grained particles 804, and an evaporated metal layer 806. In some embodiments, the porous layer 802 is formed as thin as possible while providing for a desired electrical current to flow through the metal layer 806. Providing for a thin porous layer 802 provides only a small volume in which water vapor or other moisture may accumulate that may need to be removed from the porous layer 802 when the device including the structure illustrated in FIG. 8 is utilized in a vacuum chamber. A reduction in the moisture content of the porous layer 802 may reduce a pump-down time of the vacuum chamber. In some embodiments, the porous layer 802 may have an average or median thickness of between one and ten, between one and five, or between one and three particles 804. The evaporated metal layer 806 is a contiguous layer that is formed in a pattern over the large-grained particles 804.

In some embodiments, the metal is deposited in a grid pattern (e.g., in a grid of metal lines), allowing the coverage ratio, which is the ratio of the surface area coated with the metal to the entire (i.e., coated and uncoated) surface area, to be reduced to a low level, e.g., about 10% or less, while still maintaining a layer of metal thick enough to ensure electrical continuity. The metal grid may be deposited through a shadow mask, by screen printing, or written by aerosol jet printing. In the case of a shadow mask, the metal thickness may be between 0.1 μm and 5 μm. In the case of screen printing, the metal may be thicker—e.g., up to several hundred microns. In the case of aerosol jet direct writing (e.g., Optomec aerosol jet printing), the metal lines may be 1 μm to 20 μm thick and 10 μm to 50 μm wide.

In the embodiment of FIG. 8, the metal is deposited along a line 808 that is at an angle α to a normal line 810 extending from an upper surface 812 of the β" alumina substrate 800. By depositing the metal layer 806 along the line 808, or another line that is at an angle to the normal line 810, more of the upper surface of the porous layer 802 is left uncovered by the metal layer 806 than would be if the metal layer 806 were deposited along the normal line 810. When the metal layer 806 coats a particle 804 that is in the form of a spherical grain along the normal line 810, the entire upper hemisphere of that grain is coated with the metal layer 806, which can lead to trapping of neutralized atoms below that metal layer 806. When α is between 0° and 90°, some of the upper hemisphere of the spherical grain is left uncoated by the metal layer 806, reducing the tendency of the metal layer 806 on that spherical grain to trap neutralized atoms beneath it.

Figure 9A:
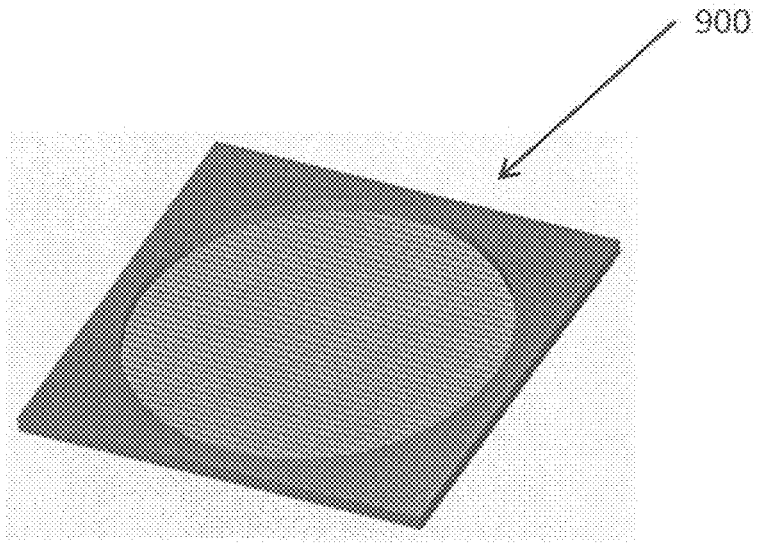
FIG. 9A shows a perspective view of a MEMS shadow mask.
Figure 9B:
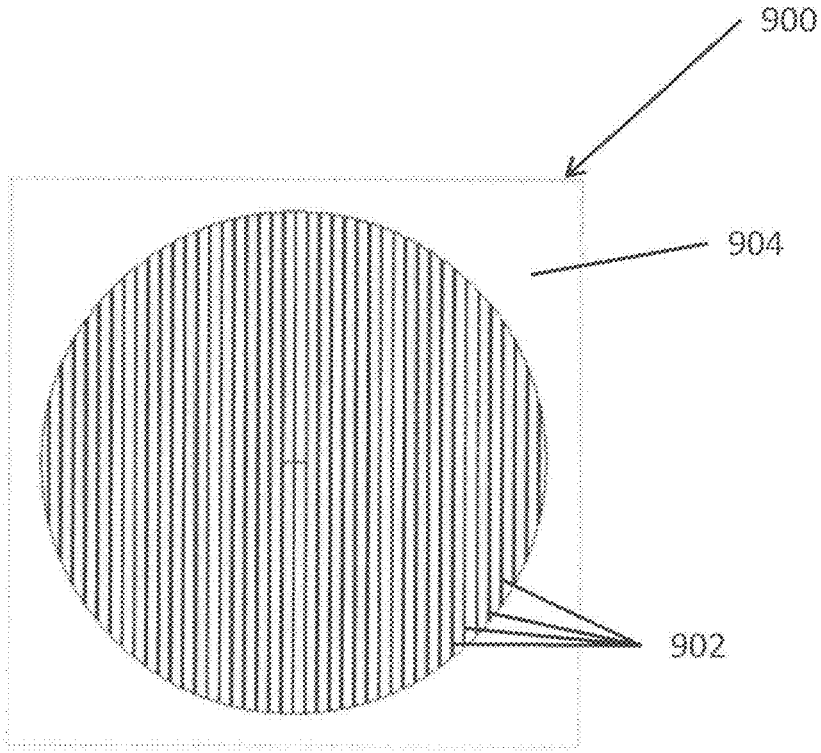
FIG. 9B shows a top view of a MEMS shadow mask.

FIG. 9A shows a perspective view of a MEMS shadow mask 900 and FIG. 9B shows a top view of the MEMS shadow mask 900. The MEMS shadow mask shown in FIGS. 9A and 9B may be fabricated by a process starting with a Silicon on Insulator (SOI) wafer. In one embodiment, the thin device layer is first etched to form the desired stripe pattern, and then a back-side etch is performed to open parallel openings 902 in the substrate 904. Finally, the buried oxide layer is etched in hydrofluoric acid (HF). The advantage of this MEMS process is that much narrower openings 902 may be fabricated using MEMS processes (e.g., lines 2-5 μm wide) than by conventional sheet-metal etching (125 μm minimum slot width) or by laser cutting (50 μm minimum slot width). Alternatively, conventional etched or laser cut metal shadow masks may be utilized to form a coarser grid pattern.

Figure 10:
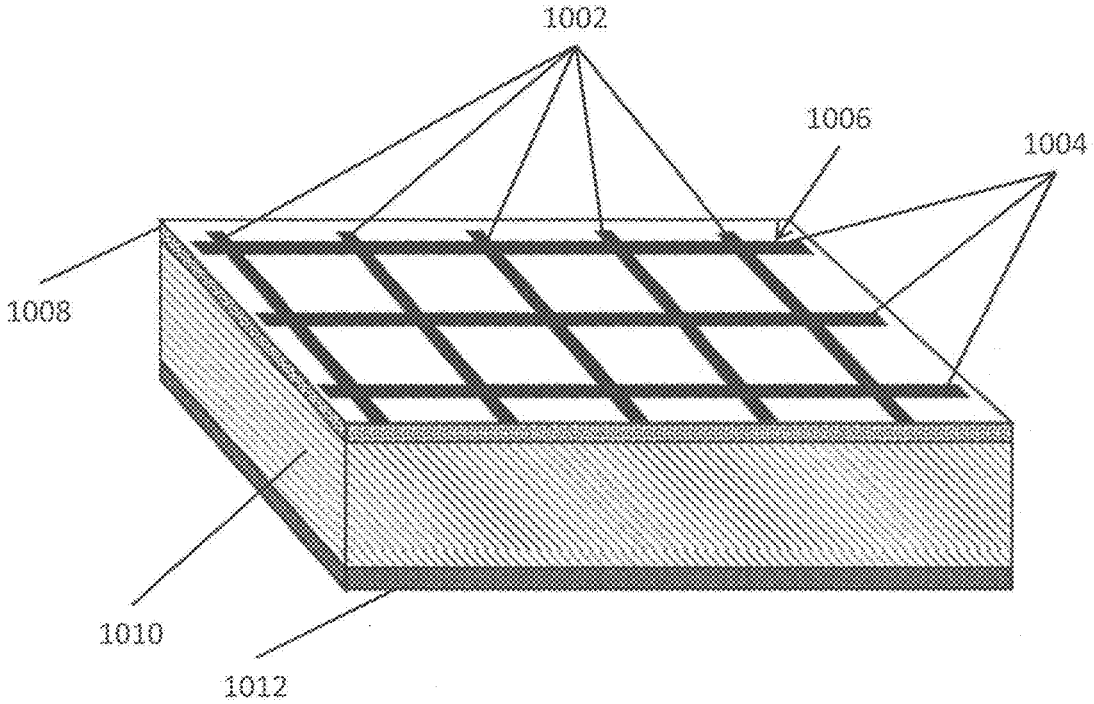
FIG. 10 shows a grid electrode deposited on a porous surface layer device.

In one embodiment, the porous side of the ion-conducting device is first metalized by evaporating or sputtering metal through the shadow mask 900 to form a first set of metal grid lines 1002, then the mask 900 is rotated 90° and a second set of metal grid lines 1004 is deposited orthogonal to the first layer of metal grid lines 1002, thereby forming a continuous square grid 1006. FIG. 10 shows one example of a grid electrode 1006 deposited on a porous ion-conducting surface layer 1008. The porous ion-conducting surface layer 1008 is positioned on an ion-conducting material 1010. On the opposite side of the ion-conducting material 1010, a solid non-blocking back electrode 1012 is placed.

Example Method 3

It is well known that ion-conducting ceramics can be molded before firing, in the green state. In some embodiments, a fine featured mold can be used to form fine grooves in the unfired, ion-conducting ceramic. Such a mold may be made identically to the mold shown in FIGS. 5A-5H. In this embodiment, fine features are formed on the mold by electroplating through a photoresist mask, forming protruding ribs which are molded into the green ceramic before firing. The process shown in FIGS. 5A-5H is applicable except that an additional firing step is added between step 5F (removing the mold) and step 5G (metallization). This firing step sinters the ceramic particles together forming a dense body, retaining the grooves that were formed by molding.

Example Method 4

Figure 11A:
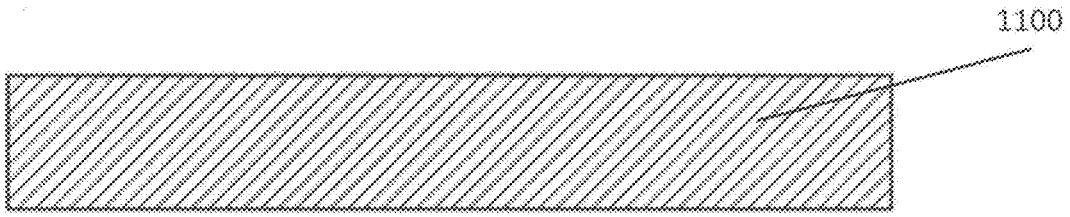
FIGS. 11A-11F show steps of a method of electrophoretic deposition of ceramic on a carbon mold to form fine featured grooves in the ceramic.
Figure 11B:
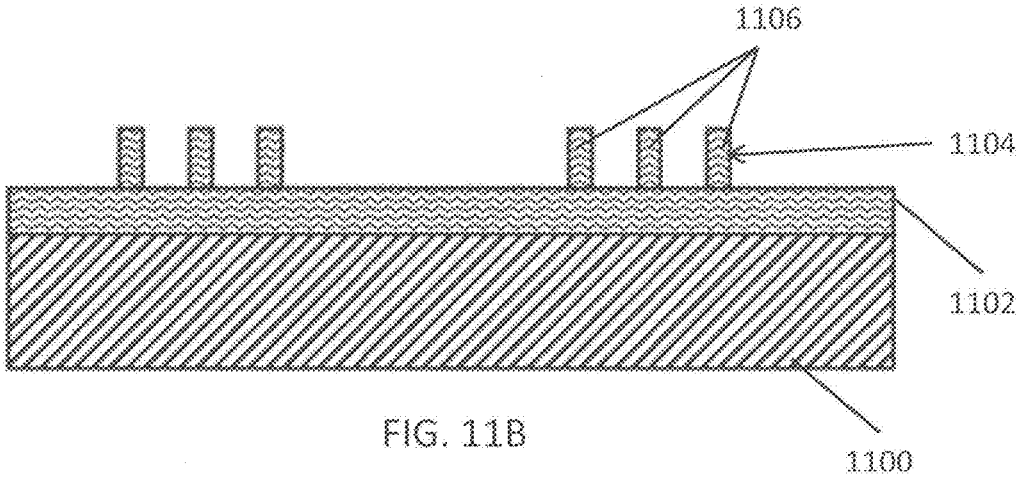
Figure 11C:
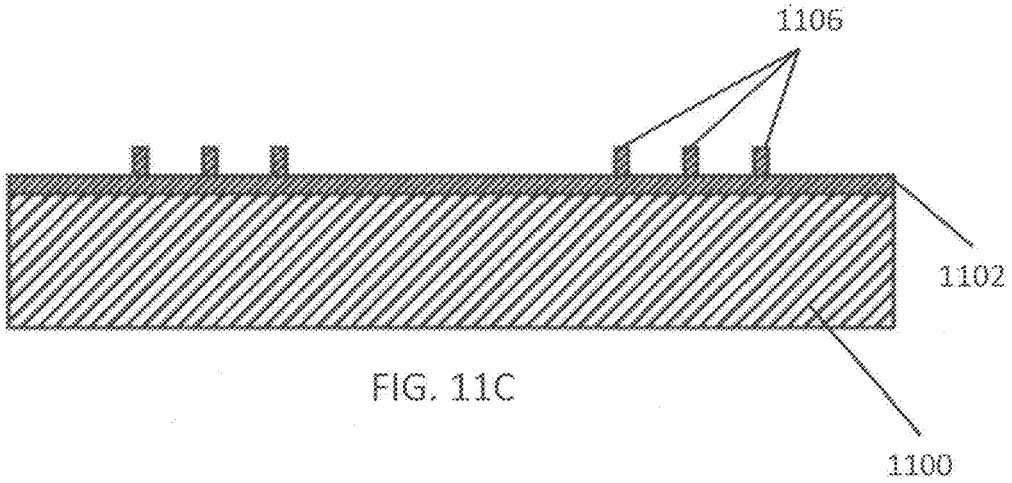

In this embodiment, ceramic particles are suspended in a liquid and deposited on a conductive surface by the application of a voltage across the suspension. A fine featured conductive mold of carbon is formed that may be removed by oxidation during the sintering step. In greater detail, FIG. 11A shows an inert, high temperature substrate 1100, such as alumina. FIG. 11B shows two layers of deposited photoresist, such as SU-8, on the substrate. The first layer of photoresist 1102 is a planar layer exposed and cross-linked everywhere. The second layer of photoresist 1104 forms a series of narrow ridges 1106 that form an interconnected network, typically a hexagonal, square, or triangular grid. The substrate 1100, the first layer of photoresist 1102, and the second layer of photoresist 1104 are heated in an inert, non-oxidizing atmosphere (e.g., $N_2$) at a temperature between 600° C. and 800° C. to convert the photoresist to pyrolytic carbon. As shown in FIG. 11C, features such as posts or ridges 1106 shrink by a factor of 2-3 during the pyrolysis.

Figure 11D:
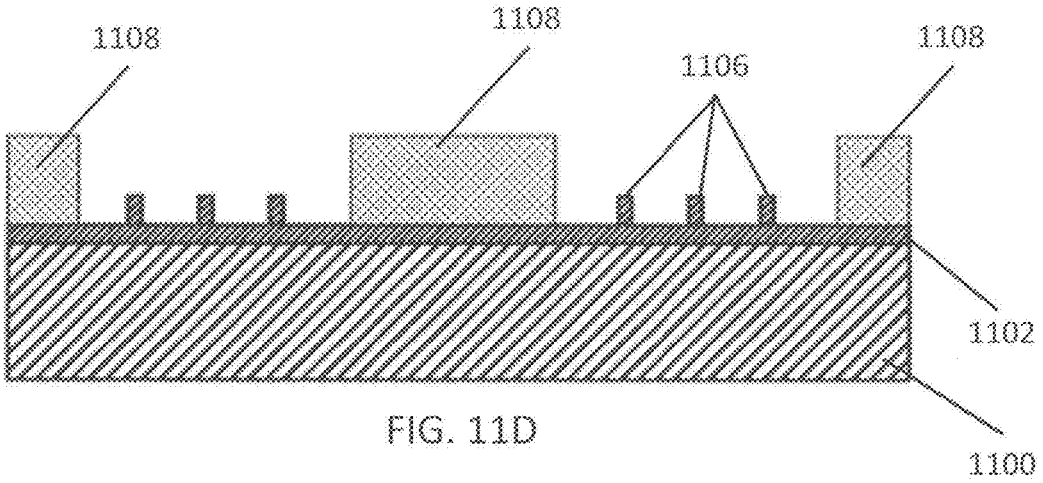
Figure 11E:
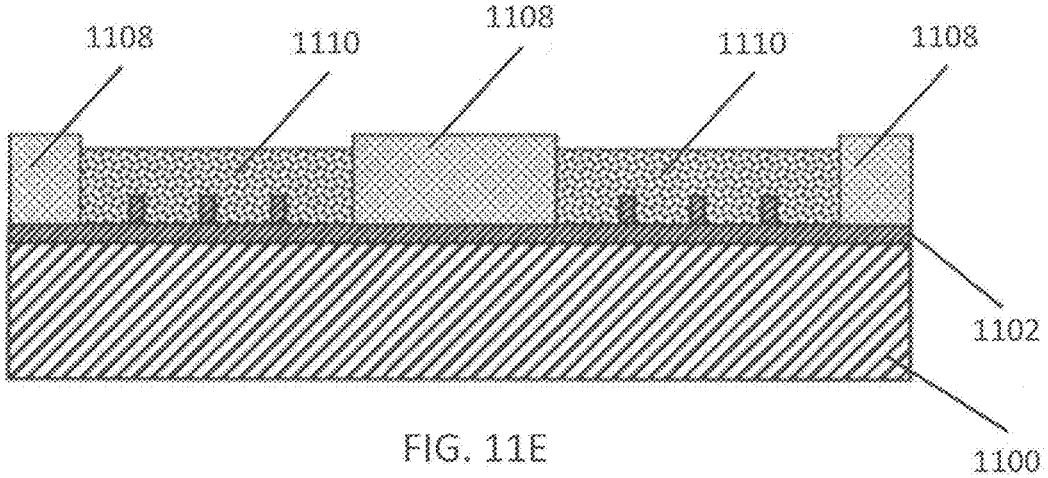
Figure 11F:
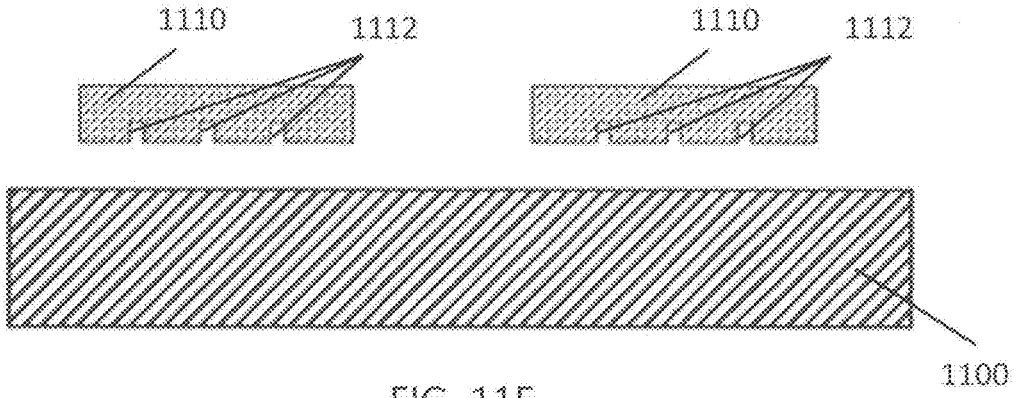

FIG. 11D shows the masked off regions of the substrate with a third layer of photoresist 1108. The masked regions will not attract ceramic deposit, whereas the open areas will grow a layer of ceramic during an electrophoretic deposition. FIG. 11E shows the ion-conducting ceramic 1110 deposited in the open areas, forming discs or other shapes. The ceramic 1110 grows over the fine carbon features 1106. In FIG. 11F, the ceramic 1110 and mold 1100 are heated to a temperature where the ceramic sinters to full density in an oxidizing atmosphere, removing the carbon layers, and leaving the ceramic bodies with fine featured grooves 1112. These grooves can then be metalized as shown in FIGS. 5G and 5H.

Figure 12:
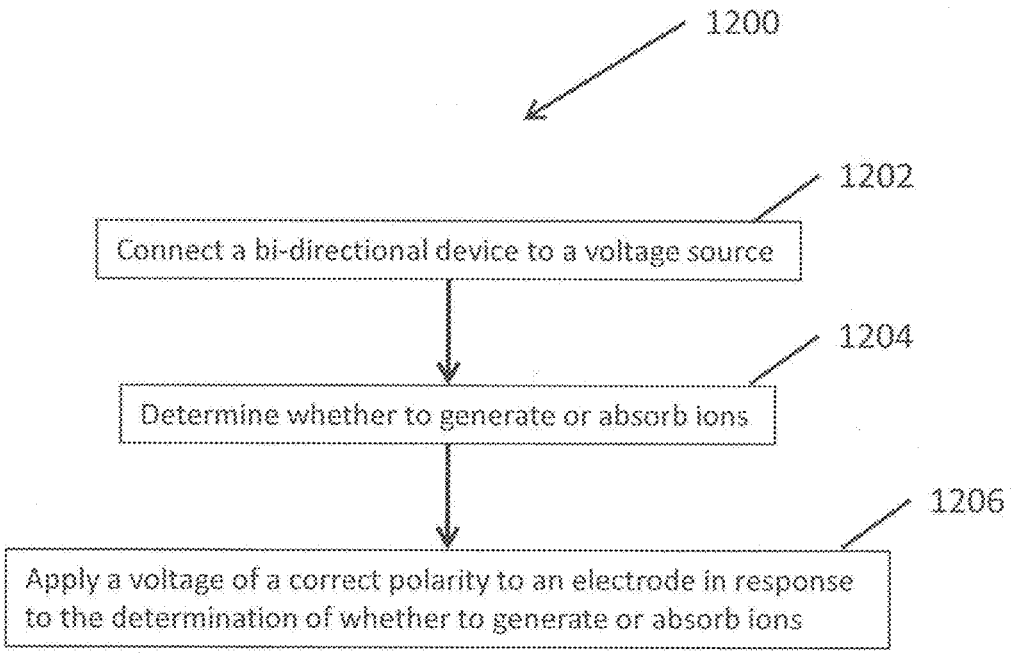
FIG. 12 is a flowchart of a method of generating or absorbing ions.

FIG. 12 is a flowchart 1200 of a method for generating or absorbing ions. At block 1202, a bi-directional device is connected to a voltage source. Block 1204 includes determining whether to generate or absorb ions. Block 1206 includes selectively applying a voltage of a correct polarity to an electrode in response to the determination made at block 1204.

Figure 13:
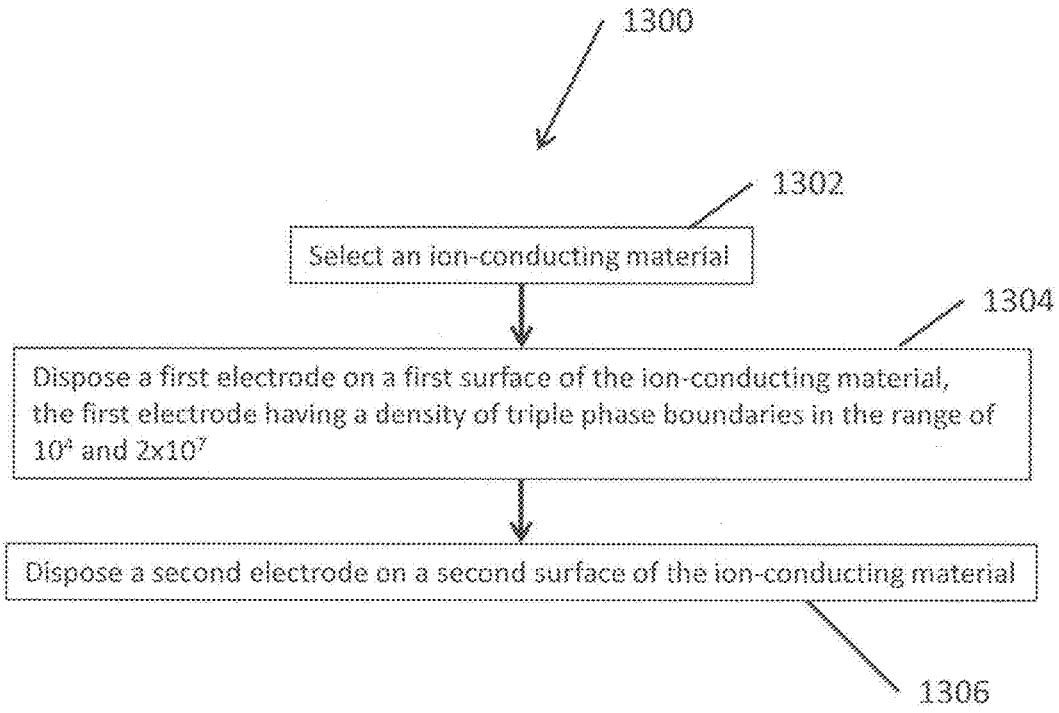
FIG. 13 is a flowchart of a method of fabricating a bi-directional device for generating or absorbing ions.

FIG. 13 is a flowchart 1300 of a method of fabricating a bi-directional device for generating or absorbing ions. At block 1302, the method 1300 includes selecting an ion-conducting material comprising a material from the group consisting of an alkali metal, an alkaline earth metal, and a rare earth metal. At block 1304, a first electrode, such as a cathode, is disposed on a first surface of the ion-conducting material. A density of triple-phase boundaries formed by the first electrode and the upper surface of the ion-conducting material is in the range from of about $10^4$ $m^{-1}$ to about $2\times10^7$ $m^{-1}$. At block 1306, a second electrode, such as an anode, is positioned on a second surface of the ion-conducting material.

Prophetic Example of a Bi-Directional Device

To test the alkali generation and absorption of a bi-directional device according to the present disclosure, the bi-directional device is placed in a vacuum chamber of a test system. The vacuum chamber may be a stainless steel cube. The vacuum chamber is pumped to a pressure of $10^{-7}$ torr. The test system includes connections to a small ceramic heater, a thermocouple, and a voltage source to drive the bi-directional device. In some embodiments, the test system includes a connection to drive an alkali source in the chamber for demonstrating absorption of alkali from the vacuum.

To measure alkali absorption, a laser is tuned to an appropriate wavelength, such as a wavelength for detecting cesium or rubidium. Using a controller and a processor, absorption of the laser energy in the chamber can be analyzed.

A bi-directional device is placed on a ceramic heater within the chamber, and the bi-directional device is connected to a voltage source. The controller uses laser absorption to measure the partial pressure of the alkali vapor in the chamber.

When providing a voltage of 10 volts and a current of 7 microamps to a bi-directional device according to the present disclosure, the controller can measure an efficiency of 10% for some embodiments an efficiency of up to 50% for some embodiments. The measured alkali vapor concentration in the chamber can be reduced by 50% in a matter of minutes. In some embodiments, the measured alkali concentration in the chamber can be reduced by 90% in a matter of minutes or over a few seconds, depending on the size of the chamber.

A thermocouple may detect a temperature of less than 200° C. on the ion-conducting material in some embodiments. A thermocouple may detect a temperature of less than 170° C. on the ion-conducting material in some embodiments.

By applying a voltage of a first polarity to a first electrode and a second polarity to the second electrode, the bi-directional device can be used for absorbing ions. By applying a voltage of the second polarity to the first electrode and the first polarity to the second electrode, the bi-directional device can be used for generating ions.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. The features and functions of the various embodiments may be arranged in various combinations and permutations, and all are considered to be within the scope of the disclosed invention. Unless otherwise necessitated, recited steps in the various methods may be performed in any order and certain steps may be performed substantially simultaneously. Accordingly, the described embodiments are to be considered in all respects as only illustrative and not restrictive. Furthermore, the configurations, materials, and dimensions described herein are intended as illustrative and in no way limiting. Similarly, although physical explanations have been provided for explanatory purposes, there is no intent to be bound by any particular theory or mechanism, or to limit the claims in accordance therewith.

What is claimed is:

1. A bi-directional device for generating or absorbing atoms or ions, the device comprising:

a solid-phase ion-conducting material, the solid-phase ion-conducting material including an element selected from the group consisting of an alkali metal, an alkaline earth metal, and a rare earth metal;

a first electrode positioned on a first surface of the solid-phase ion-conducting material;

a second electrode positioned on a second surface of the solid-phase ion-conducting material;

a plurality of triple phase boundaries, each triple phase boundary located at an interface between the solid-phase ion-conducting material and the first electrode; and a density of the triple phase boundaries in the range of about $10^4$ m/m$^2$ to about $2\times10^7$ m/m$^2$ on the first surface of the ion-conducting material.

2. The device of claim 1, wherein the first electrode covers less than 10% of the first surface.

3. The device of claim 1, wherein the first electrode covers less than 3% of the first surface.

4. The device of claim 1, wherein the first electrode includes a plurality of contiguous ion-conducting particles disposed on the first surface, the plurality of contiguous ion-conducting particles leaving contiguous interstitial spaces.

5. The device of claim 4, wherein a largest dimension of each interstitial space is between about 0.1 microns and about 10 microns.

6. The device of claim 1, the first electrode being positioned in a plurality of grooves in the first surface of the solid-phase ion-conducting material.

7. The device of claim 6, wherein the second electrode comprises one of silver and copper.

8. The device of claim 1, wherein the solid-phase ion-conducting material is selected from a material capable of generating or absorbing an atom or an ion.

9. The device of claim 1, further comprising a temperature control device operatively connected to the solid-phase ion-conducting material.

10. A method of generating or absorbing atoms or ions comprising:

connecting a bi-directional device to a voltage source, the bi-directional device being capable of generating or absorbing atoms or ions, the bi-directional device comprising a first electrode positioned on and covering less than 10% of a first surface thereof and a second electrode positioned on a second surface thereof;

determining whether to generate or absorb atoms or ions; and selectively applying a voltage of a correct polarity to the first electrode of the bi-directional device in response to the step of determining whether to generate or absorb atoms or ions.

11. The method of claim 10, wherein the bi-directional device has a conversion efficiency of between one atom and five atoms per 10 electrons flowing through the first electrode.

12. The method of claim 10, further comprising:

determining a desired partial pressure of atoms in an atomic sensor system;

sensing a partial pressure of atoms in the atomic sensor system; and controlling the voltage to release atoms into or to absorb atoms from the atomic sensor system based on the sensed partial pressure of atoms in the atomic sensor system to achieve the desired partial pressure.

13. The method of claim 10, further comprising directing the atoms to provide thrust for a vehicle.

14. The method of claim 10, further comprising ion beam etching a surface of a workpiece, wherein controlling the voltage causes the bi-directional device to release ions.

15. A method of fabricating a bi-directional device for generating or absorbing atoms or ions, the method comprising:

selecting a solid-phase ion-conducting material comprising a material from the group consisting of an alkali metal, an alkaline earth metal, and a rare earth metal;

positioning a first electrode on a first surface of the solid-phase ion-conducting material, the first electrode having a plurality of triple phase boundaries, each triple phase boundary located at an interface between the solid-phase ion-conducting material and the first electrode, and a density of the triple phase boundaries in the range of about $10^4$ m/m$^2$ to about $2\times10^7$ m/m$^2$ on the first surface of the ion-conducting material; and positioning a second electrode on a second surface of the solid-phase ion-conducting material.

16. The method of claim 15, wherein the first electrode covers less than 10% of the first surface.

17. The method of claim 15, wherein positioning the first electrode on the first surface of the solid-phase ion-conducting material comprises:

creating grooves within the first surface; and positioning an electrically conductive material within the grooves.

18. The method of claim 17, wherein selecting the solid-phase ion-conducting material comprises selecting a ceramic material and the method further comprises firing the ceramic material.

19. The method of claim 18, further comprising removing a first portion of the electrically conductive material extending above an upper surface of the solid-phase ion-conducting material after positioning the electrically conductive material within the grooves such that a second portion of the electrically conductive material remains in the grooves.

20. The method of claim 15, wherein positioning the first electrode on the first surface of the solid-phase ion-conducting material comprises positioning a mixture of an ion-conducting powder and an electron-conducting powder on the first surface.

21. The method of claim 20, further comprising sintering the mixture onto the ion-conducting material.

22. The method of claim 17, wherein creating grooves within the first surface comprises:

molding grooves into the first surface; and firing the solid-phase ion-conducting material.

23. The method of claim 15, wherein selecting the solid-phase ion-conducting material further comprises:

selecting a first ceramic material having a first grain size and a second ceramic material having a second grain size; and positioning a layer of the second ceramic material on a layer of the first ceramic material.

24. The method of claim 23, wherein selecting the first ceramic material comprises selecting β" alumina.

25. The method of claim 24, wherein selecting the second ceramic material comprises selecting β" alumina.

26. The method of claim 23, further comprising firing the first ceramic material and the second ceramic material.

27. The method of claim 26, wherein positioning the first electrode further comprises disposing a metal layer on the second ceramic material after firing the first ceramic material and the second ceramic material.

28. The method of claim 27, wherein disposing the metal layer comprises disposing the metal layer in a grid pattern by one of shadow masking, screen printing, and aerosol jet printing.

29. The method of claim 27, wherein disposing the metal layer further comprises disposing the metal layer at an angle relative to a line normal to an upper surface of the solid-phase ion-conducting material.

30. The method of claim 15, wherein selecting the solid-phase ion-conducting material further comprises depositing a ceramic material via electrophoresis over a carbon mold.

31. The method of claim 30, further comprising:

sintering the ceramic material by heating the ceramic material and the carbon mold in an oxidizing atmosphere; and removing the carbon mold.

* * * * *